US007802963B2

(12) United States Patent
Holland et al.

(10) Patent No.: US 7,802,963 B2
(45) Date of Patent: Sep. 28, 2010

(54) PIVOT RING

(75) Inventors: Clive R Holland, Derby (GB); David M Lambert, Derby (GB)

(73) Assignee: Rolls-Royce plc, London (GB)

( * ) Notice: Subject to any disclaimer, the term of this patent is extended or adjusted under 35 U.S.C. 154(b) by 1212 days.

(21) Appl. No.: 11/353,111

(22) Filed: Feb. 14, 2006

(65) Prior Publication Data

US 2006/0198982 A1 Sep. 7, 2006

(30) Foreign Application Priority Data

Mar. 5, 2005 (GB) ..... 0504588.5

(51) Int. Cl.
*F01D 17/16* (2006.01)

(52) U.S. Cl. ..... 415/148; 415/159; 415/200

(58) Field of Classification Search ..... 415/148, 415/150, 159, 162, 200
See application file for complete search history.

(56) References Cited

U.S. PATENT DOCUMENTS

| | | | | |
|---|---|---|---|---|
| 2,671,634 | A | 3/1954 | Morley | |
| 3,788,763 | A * | 1/1974 | Nickles | 415/147 |
| 4,150,915 | A * | 4/1979 | Karstensen | 415/139 |
| 4,214,852 | A * | 7/1980 | Tuley et al. | 415/115 |
| 4,231,703 | A | 11/1980 | Weiler | |
| 4,514,141 | A * | 4/1985 | Marey | 415/160 |
| 4,604,030 | A * | 8/1986 | Naudet | 415/126 |
| 4,773,817 | A * | 9/1988 | Stangalini et al. | 415/48 |
| 4,812,106 | A * | 3/1989 | Purgavie | 415/139 |
| 5,324,165 | A * | 6/1994 | Charbonnel et al. | 415/160 |
| 5,466,122 | A | 11/1995 | Charbonnel | |
| 6,086,327 | A | 7/2000 | Mack et al. | |
| 6,413,043 | B1 | 7/2002 | Bouyer | |
| 2001/0045877 | A1 | 11/2001 | Christian | |

FOREIGN PATENT DOCUMENTS

| | | |
|---|---|---|
| EP | 0 387 122 A | 9/1990 |
| EP | 1 319 844 A | 6/2003 |
| FR | 2 824 593 A | 11/2002 |
| GB | 1 092 557 SP | 11/1967 |
| GB | 1 533 940 SP | 11/1978 |
| RU | 2 117 826 AB | 8/1998 |
| WO | WO 01/46053 PU | 6/2001 |

* cited by examiner

*Primary Examiner*—Igor Kershteyn
(74) *Attorney, Agent, or Firm*—Jeffrey S. Melcher; Manelli Denison & Selter PLLC

(57) ABSTRACT

A pivot ring arrangement for a stage of variable stator vanes (VSVs) (38) in a gas turbine engine comprises a plurality of segments (12) secured in a segment carrier (22). The segments are injection molded from self-lubricating material, obviating the need for separate bushes for the VSV spindles (36).

11 Claims, 2 Drawing Sheets

PIVOT RING

BACKGROUND OF THE INVENTION

This invention relates to gas turbine engines, and more particularly to mounting arrangements for variable stator vanes in gas turbine engines.

It is known to provide variable stator vanes (VSVs) in gas turbine engines, to improve their performance and stability, especially where high pressure ratios are required. Such vanes are able to pivot about a substantially radial axis, so as to change the angle they present to the incoming air. VSVs that are situated before the first rotor stage of a compressor are commonly referred to as variable inlet guide vanes (VIGVs).

VSVs have a spindle at each end; the spindles are located in bushes fitted into a pivot ring. For ease of assembly and disassembly, the pivot ring is usually made in two semicircular sections. Known pivot rings are commonly made from aluminium, and require complex machining during manufacture, both to form the functional shape of the ring and for weight reduction. Bushes, typically of Vespel, are fitted into holes in the ring and provide bearing surfaces for the VSVs. The fitting of the bushes adds further cost and complexity to the manufacture of the pivot ring.

It is an objective of this invention to provide a mounting arrangement for VSVs that overcomes the disadvantages of cost and complexity associated with known pivot rings.

BRIEF SUMMARY OF THE INVENTION

According to one aspect of this invention, a pivot ring segment for a gas turbine engine is made from a self-lubricating material.

The material may be an advanced engineering polymer (AEP) material.

Preferably, the segment is injection moulded.

The segment may have at least one flattened portion to accommodate the movement of a variable vane.

According to a second aspect of the invention, a pivot ring arrangement for a gas turbine engine comprises a plurality of pivot ring segments according to any of the preceding four paragraphs secured in a segment carrier.

Preferably, the thermal expansion coefficient of the segment carrier is substantially the same as that of the segments.

The segment carrier may be made of corrosion-resistant steel or of titanium alloy.

BRIEF DESCRIPTION OF THE DRAWINGS

An embodiment of the invention will now be described, by way of example, with reference to the accompanying drawings in which.

DETAILED DESCRIPTION OF THE INVENTION

Figure 1:
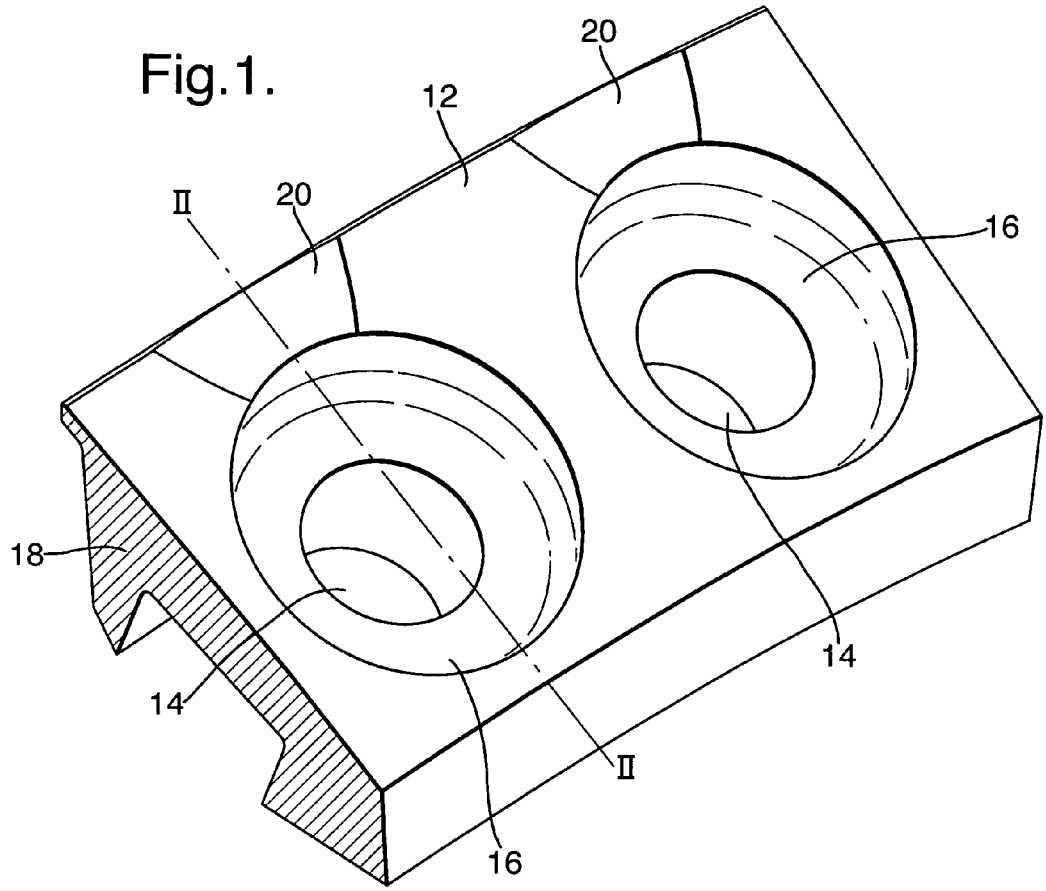
FIG. 1 is an isometric view of a segment for a pivot ring assembly according to the invention.

In FIG. 1, a pivot ring segment 12 is injection moulded from an advanced engineering polymer (AEP) material, such as Torlon®. (AEP materials are distinguished from other engineering polymers by their high temperature capability (Torlon® is usable up to 250° C.) and they retain their mechanical properties (UTS, stiffness, etc.) close to that maximum operating temperature.)

Holes 14 accommodate the spindles of two variable inlet guide vanes (VIGVs) and allow them to rotate. Further features 16 provide a clearance for the aerodynamic "penny" of the VIGV. Twenty-nine of these segments 12 are arranged in an annular array around the circumference of the engine, with their end faces 18 abutting.

Figure 2:
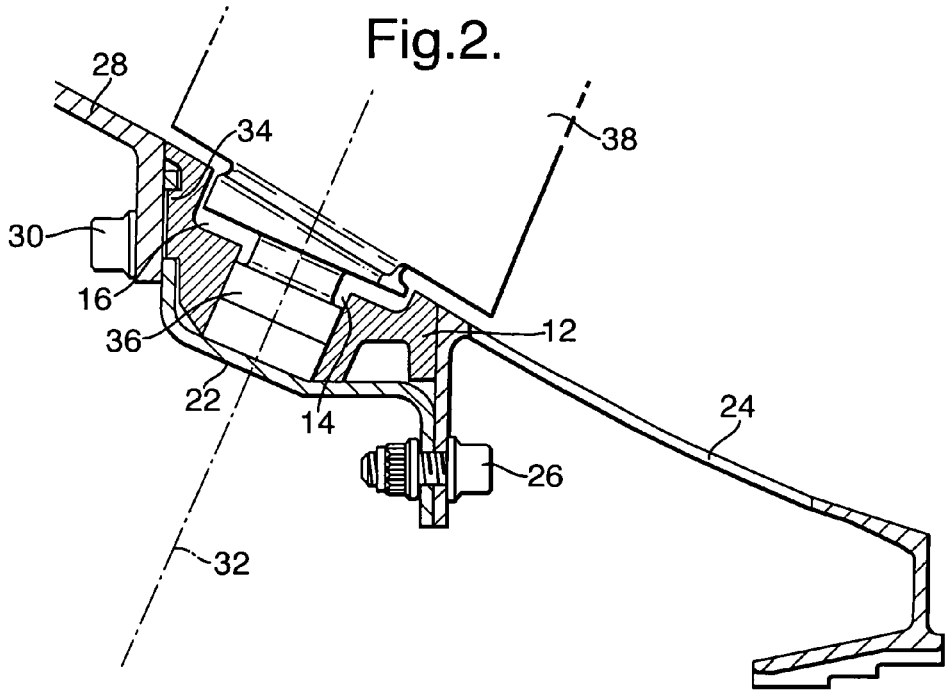
FIG. 2 is a section (on the line II-II of FIG. 1) through the segment of FIG. 1 and its adjacent components in the engine.

FIG. 2 is a section through a single pivot ring segment 12 and its adjacent components in the engine, on the line II-II of FIG. 1. The pivot ring segments 12 are located in a segment carrier 22, by two circular bosses 34 on each segment 12. The segment carrier 22 is made from corrosion-resistant steel and forms a continuous ring around the engine. The segment carrier 22 is secured to a seal carrier 24 by a plurality of bolts 26 spaced around its circumference, and to the front bearing housing 28 by a plurality of bolts 30, likewise spaced around its circumference. The VIGV spindle 36 fits through the hole 14, allowing the VSV 38 to rotate about an axis of rotation 32.

Because the pivot ring segments are formed from Torlon®, there is no need for separate low-friction bushes to support the VIGVs.

Figure 3:
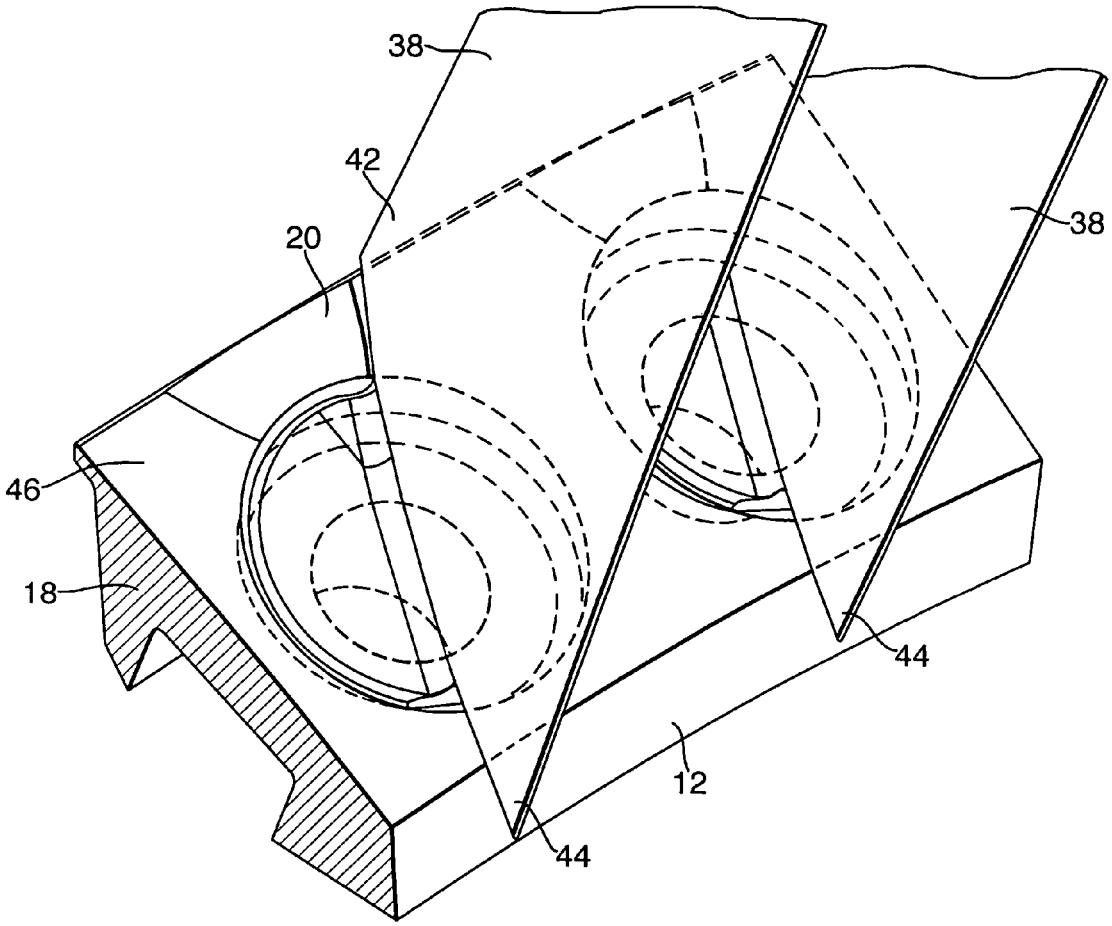
FIG. 3 is an isometric view of the segment of FIG. 1, showing two variable stator vanes in place.

FIG. 3 shows the pivot ring segment of FIG. 1, with two VIGVs 38 in place. As the VIGVs are rotated in use, the corners 42, 44 of the aerofoils move essentially in a linear fashion. However, because the VIGVs 38 are arranged in a circle, the radially inner face 46 of the pivot ring presents a circular profile. In conventional pivot ring assemblies, it has been necessary to cut away the corners 42, 44 of the aerofoils so that their essentially linear movement does not cause them to foul against the circular profile of the pivot ring inner face 46 at the extremes of the vane's movement. In the present invention, the injection moulding technique permits flattened portions 20 to be incorporated into the segments 12, so that the linear movement of the aerofoil corners 42 can be accommodated without compromising the form of the VIGV 38. The gap between the vane and the pivot ring is therefore smaller than in known pivot ring assemblies, which reduces losses.

The invention therefore provides a mounting arrangement for VIGVs which has lower cost, weight and complexity than conventional arrangements.

It will be appreciated that various modifications may be made to the embodiment described without departing from the scope of the invention.

For example, the pivot ring segments may be made from a different material, provided that its frictional properties are suitable (dynamic coefficient of friction below about 0.5). Two other materials with similar wear characteristics to Torlon® are Celazole® and Vespel®.

The pivot ring segments may be made by other means than injection moulding (Celazole® and Vespel®, for example, cannot be formed by injection moulding).

The number of VIGVs accommodated by each pivot ring segment may be different.

The segment carrier may be made from an alternative material, for example from titanium alloy. While corrosion-resistant steel offers the greatest cost saving over the prior art design, a titanium alloy component would offer a greater weight reduction, and this may be of greater benefit in some circumstances. The segment carrier may be made in one piece, or it may be fabricated from two or more parts, for example by welding.

We claim:

1. A variable stator vane mounting ring segment for a gas turbine engine comprising:

a variable stator vane mounting ring segment formed only from a self-lubricating advanced engineering polymer material.

2. A mounting ring segment as in claim 1, wherein the segment is injection moulded.

3. A mounting ring segment as in claim 1, wherein the segment has at least one flattened portion to accommodate the movement of a variable vane.

4. A mounting ring segment according to claim 1, the segment further comprising a circular inner surface constructed and arranged to be in contact with a spindle of a variable stator during use.

5. A variable stator vane mounting ring arrangement for a gas turbine engine, comprising:

a plurality of mounting ring segments secured in a segment carrier, wherein the mounting ring segments are formed only from a self-lubricating advanced engineering polymer material.

6. A mounting ring arrangement as in claim 5, wherein the thermal expansion coefficient of the segment carrier is substantially the same as that of the segments.

7. A mounting ring arrangement as in claim 5, wherein the segment carrier is made of corrosion-resistant steel or of titanium alloy.

8. A mounting ring arrangement according to claim 5, wherein the mounting ring segments comprise at least one flattened portion to accommodate the movement of a variable stator vane, the mounting ring and flattened portion being formed by injection moulding.

9. A method of making a variable stator vane mounting ring segment, the method comprising:

forming a variable stator vane mounting ring segment having a circular inner surface constructed and arranged to contact a spindle of a variable stator vane only from a self-lubricating advanced engineering polymer material by injection moulding.

10. The method according to claim 9, further comprising forming at least one flattened portion on the segment to accommodate the movement of a variable stator vane mounted in the segment, the flattened portion being formed by injection moulding.

11. The method according to claim 10, further comprising mounting a plurality of the segments in a carrier, and mounting at least one spindle of a variable stator vane within the segments so that the inner surface of the segments contacts the spindle.

* * * * *